United States Patent [19]

Jellies

[11] 4,315,495

[45] Feb. 16, 1982

[54] STABILIZER FOR HINGE OF REMOVABLE OVEN DOOR

[75] Inventor: David A. Jellies, Cleveland, Tenn.

[73] Assignee: Magic Chef, Inc., Cleveland, Tenn.

[21] Appl. No.: 203,503

[22] Filed: Nov. 3, 1980

[51] Int. Cl.[3] ..... F23M 7/00

[52] U.S. Cl. ..... 126/194; 49/386; 126/192

[58] Field of Search ..... 126/192, 191, 194; 49/386, 463; 16/180, 181, 149

[56] References Cited

U.S. PATENT DOCUMENTS 3,842,542 10/1954 White et al. ..... 126/194

*Primary Examiner*—Samuel Scott
*Assistant Examiner*—G. Anderson
*Attorney, Agent, or Firm*—Bacon & Thomas

[57] ABSTRACT

An oven door has a sleeve removably receiving a hinge element so the door may be released from its hinges for easy oven cleaning. The hinge element is in the form of an elongated and generally tubular structure having a somewhat resilient lever in its hollow interior, the lever being pivoted between its ends to the hinge element. The ends of the lever have projections extending out from a side of the hollow hinge element for resilient engagement with the sleeve to eliminate looseness between the door and hinge element.

3 Claims, 3 Drawing Figures

STABILIZER FOR HINGE OF REMOVABLE OVEN DOOR

BACKGROUND OF THE INVENTION

This invention is in the field of removable oven doors for ranges, electric or the like, and relates to means associated with the hinges of the door.

It is currently the practice to mount the oven doors of gas and electric ovens so they are removable for ease of cleaning spills within the oven. This is accomplished by having a pair of hinge elements hinged to the range structure and which slide into channels or pockets in the door. The door can be lifted off and put back on when the door is in the "broil stop" position (partially open). In order for these hinge elements to fit easily in the pocket and allow for variations in enamel thickness and metal deformation during processing, this pocket is conventionally made to provide a loose fit on the hinge elements. When the door is opened and closed, this looseness creates an objectionable noise.

The above-noted objection has been recognized heretofore and a proposed solution is described in the patent to White (U.S. Pat. No. 3,842,542). In that patent, the sleeve or pocket in the oven door and the hinge element receivable therein are provided with struckout tabs that are intended to resiliently engage the other element to overcome the looseness referred to above.

SUMMARY OF THE INVENTION

The present invention solves the problem noted above by providing a resilient stabilizer member within the hollow hinge element and which is rotatably mounted inside the hinge element. The rotatable stabilizer is mounted on the same hinge pin that pivotally mounts a stop bracket to the hinge element and in a preferred form of the invention, two such stabilizer members are provided. Each stabilizer member has end portions projecting outwardly through openings in the side of the hinge element to frictionally engage the inner surface of the sleeve or pocket in the oven door and to provide an interference fit therein. When the oven door is forced down over the hinge element, the stabilizer members are flexed and bear resilient pressure against the sleeve inner surface to eliminate any looseness or objectionable noise when opening and closing the door. However, the pressure applied by the stabilizing member is sufficiently small so as to allow easy removal of the door.

DESCRIPTION OF THE PREFERRED EMBODIMENT

Figure 1:
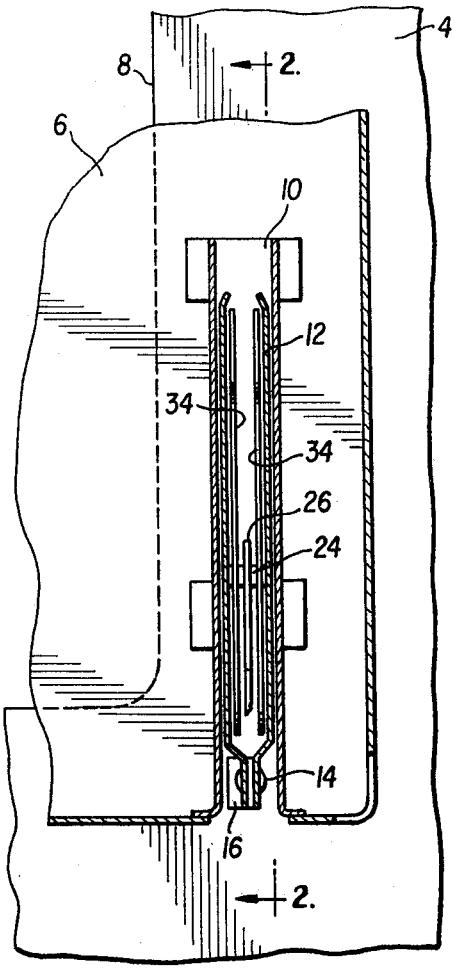
FIG. 1 is a vertical sectional view, taken along the line 1—1 of FIG. 2, illustrating a hinge structure embodying the present invention.
Figure 2:
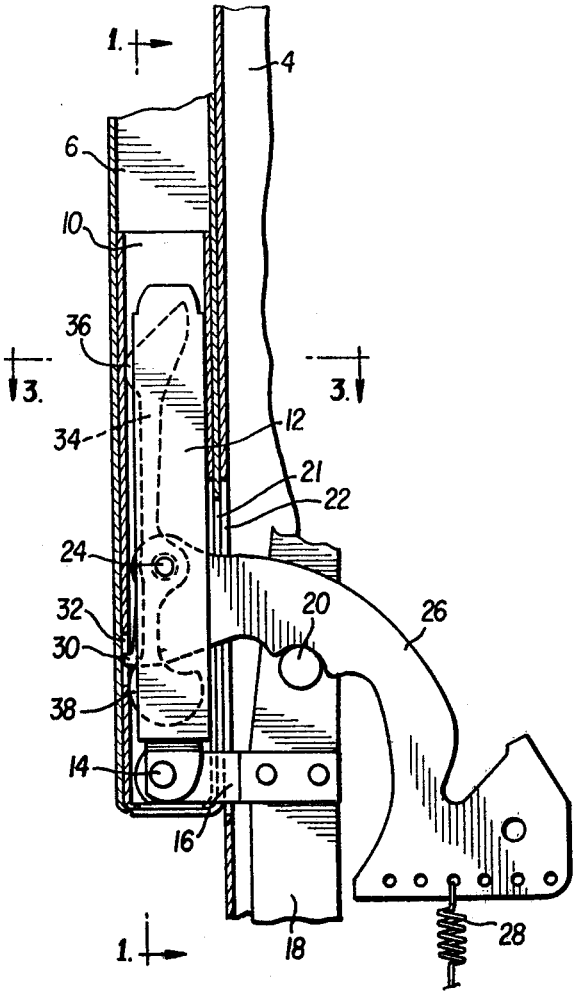
FIG. 2 is a vertical sectional view, taken along the line 2—2 of FIG. 1.

In the Figures, numeral 4 indicates generally the front portion of a stove or range which may be either gas or electric. An oven door 6 is hinged to the range front to selectively close the oven opening 8, all of which is conventional.

The oven door is provided with a sleeve or pocket in the form of a generally tubular structure 10 that is hollow and open at the end to receive a hinge element 12, hinged to the oven at 14 by being pivoted to a bracket member 16 which is fixed to a further bracket 18 within the range cabinet and which carries a pin or roller 20 for a purpose to be described. The hinge element 12 is of hollow construction and is provided with a slot along one edge opposed to a slot 21 in the inner side of the oven door and a slot 22 in the range front and through which a stop bracket 26 extends. The hinge element 12 is slidably received within the pocket or sleeve 10. A pivot pin 24 supports the stop bracket 26 which is thereby pivoted to the hinge element 12. In the finished range, a tension spring 28 normally urges the stop bracket 26 to pivot downwardly about pin 24 and against the roller or pin 20 and a projection 30 on the stop bracket enters an opening 32 in the sleeve 10 when the door is closed to thereby prevent removal of the door from its hinge. Thus far the structure is more or less conventional and serves as a background for the invention.

As stated previously, the sleeve or pocket 10 is normally surfaced by an enamel that is baked thereon and in the processing of the parts, the metal may become somewhat deformed and it is thus necessary to provide substantial clearance between all sides of the hinge element 12 and the sleeve or pocket 10. As also previously stated, the looseness of the fit creates an objectionable noise when the oven door is opened or closed.

The pivot pin 24 which supports the stop bracket 26 on the hinge element 12 also pivotally supports a pair of stabilizer members 34. The stabilizer members 34 are so constructed that shaped end portions 36 and 38 thereof project laterally outwardly through slots (not identified) in the hinge element 12 and project sufficiently far to engage the adjacent inner surface of the sleeve or pocket 10 when the hinge element is inserted therein. In fact, the end portions 36 and 38 project outwardly sufficient far so as to create an interference fit within the pocket 10 and thus the forcing of the hinge element into the pocket results in flexing the narrow leg portions of the stabilizer members and applying resilient pressure to the side of the pocket 10 to eliminate the noise and looseness previously referred to. However, the interference is such that a sufficiently strong frictional force is applied to the pocket 10 to eliminate the looseness but is still small enough to permit easy withdrawal of the oven door upwardly when it is opened partially and sufficiently to remove the projection 30 from the opening 32.

Figure 3:
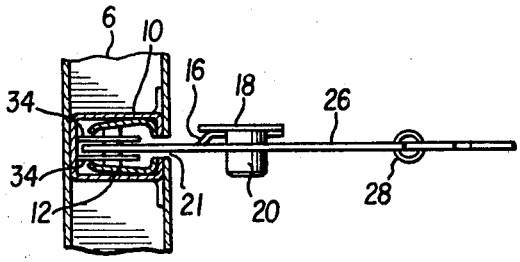
FIG. 3 is a transverse sectional view taken substantially along the line 3—3 of FIG. 2, with the range front itsself being omitted.

As shown in FIG. 3, the stabilizer elements 34 are provided as a pair, one on each side of the stop bracket 26. This ensures that there will always be sufficient pressure to eliminate the looseness referred to above and to compensate for uneven clearances.

One of the advantages of the pivoted stabilizer member over one that is integral with the material of the pocket is that the stabilizer member may be of thinner material and of a desired resilience. The pivotal mounting of the stabilizer member ensures equal pressure at each end even though the front and back walls of the pocket may be non-uniformly spaced.

While a single specific embodiment of the invention has been shown and described herein, the same is merely illustrative of the principles involved and other forms may be employed within the scope of the appended claims.

What is claimed is:

1. In stabilizing means for the hinge of a removable oven door wherein the oven door is provided with a pocket to removably receive an elongated hollow hinge element pivoted to a range, the improvement comprising:

a resilient stabilizer member mounted in said hollow hinge element and having spaced ends projecting from one side thereof sufficiently to engage an inner surface of said pocket when said element is inserted therein and flex said ends inwardly whereby to eliminate any looseness between said element and pocket, said resilient stabilizer being pivotally mounted in said hollow hinge element on a pivot axis intermediate said ends to permit limited pivotal movement of said ends inwardly and outwardly of said element.

2. Stabilizing means as defined in claim 1 wherein said element is further provided with a stop bracket having one end thereof extending into said hinge element and pivoted therein on the same axis as said stabilizer member.

3. A stabilizing means as defined in claim 2 wherein two of said stabilizing members are provided in said hinge element, one on each side of said stop bracket.

* * * * *